United States Patent [19]

Larson

[11] 4,094,610

[45] June 13, 1978

[54] PEN LOCK APPARATUS

[76] Inventor: Wesley H. Larson, P.O. Box 224, Scottsdale, Ariz. 85252

[21] Appl. No.: 765,378

[22] Filed: Feb. 3, 1977

[51] Int. Cl.[2] ..... B43K 29/00

[52] U.S. Cl. ..... 401/195; 70/34; 401/209

[58] Field of Search ..... 401/195, 209, 208; 70/34, 58; 24/211

[56] References Cited

U.S. PATENT DOCUMENTS

| | | | |
|---|---|---|---|
| 1,923,025 | 8/1933 | Morse et al. | 70/34 |
| 3,570,284 | 3/1971 | Hendricks | 401/195 X |

*Primary Examiner*—Stephen C. Pellegrino

*Attorney, Agent, or Firm*—H. Gordon Shields

[57] ABSTRACT

Pen apparatus is disclosed which includes a cooperating pen cylinder or barrel and a tip which suitably engage each other to secure a ball point pen cartridge within the apparatus, and which may be locked and unlocked by means of a wrench which includes a key portion insertable into the tip to unlock the tip from the cylinder or barrel.

5 Claims, 6 Drawing Figures

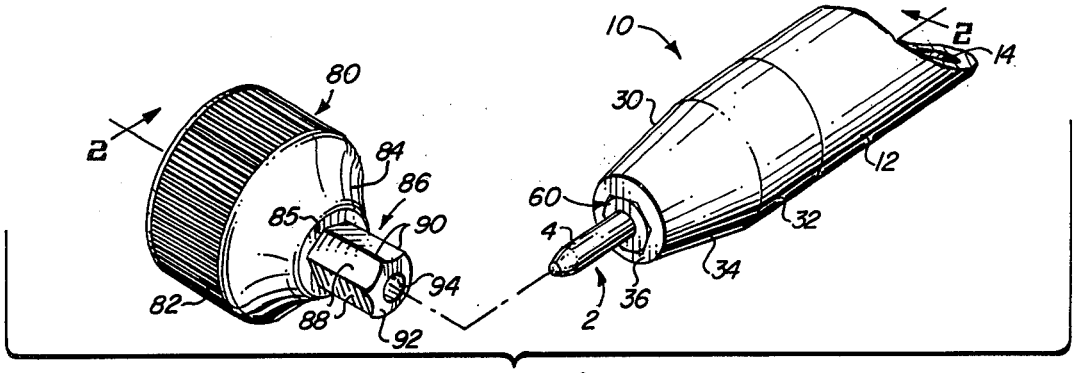
FIG. 1
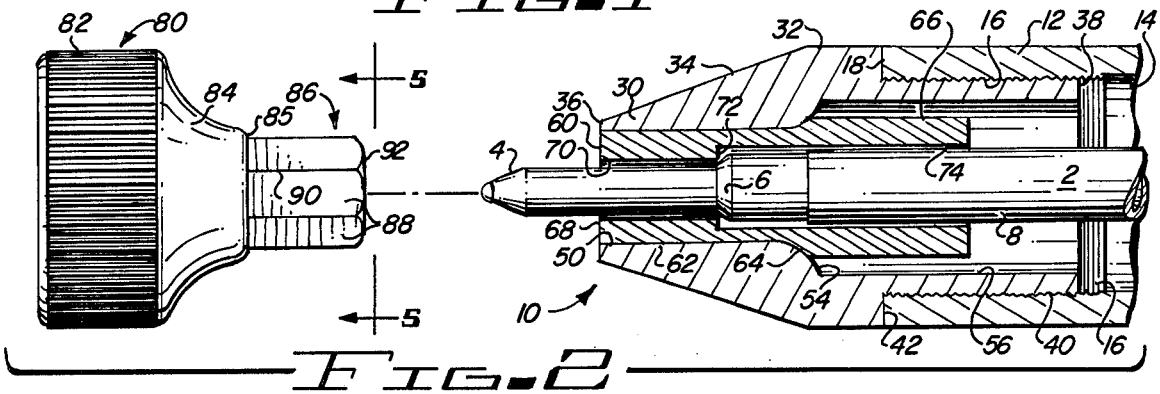
FIG. 2
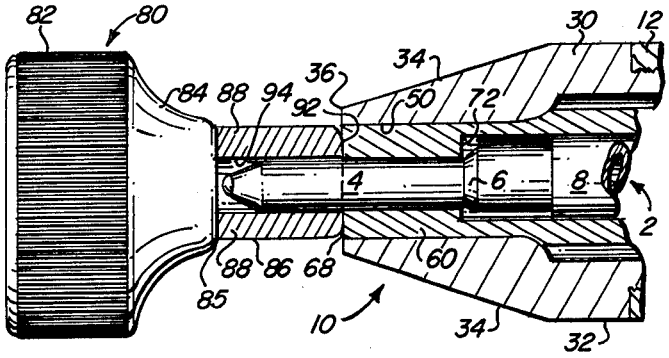
FIG. 3
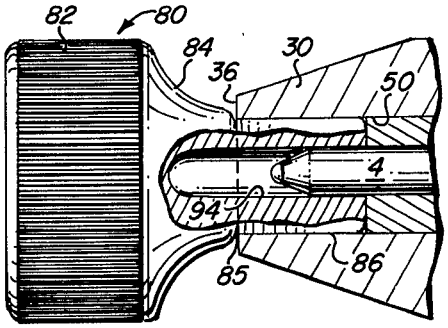
FIG. 4
FIG. 5
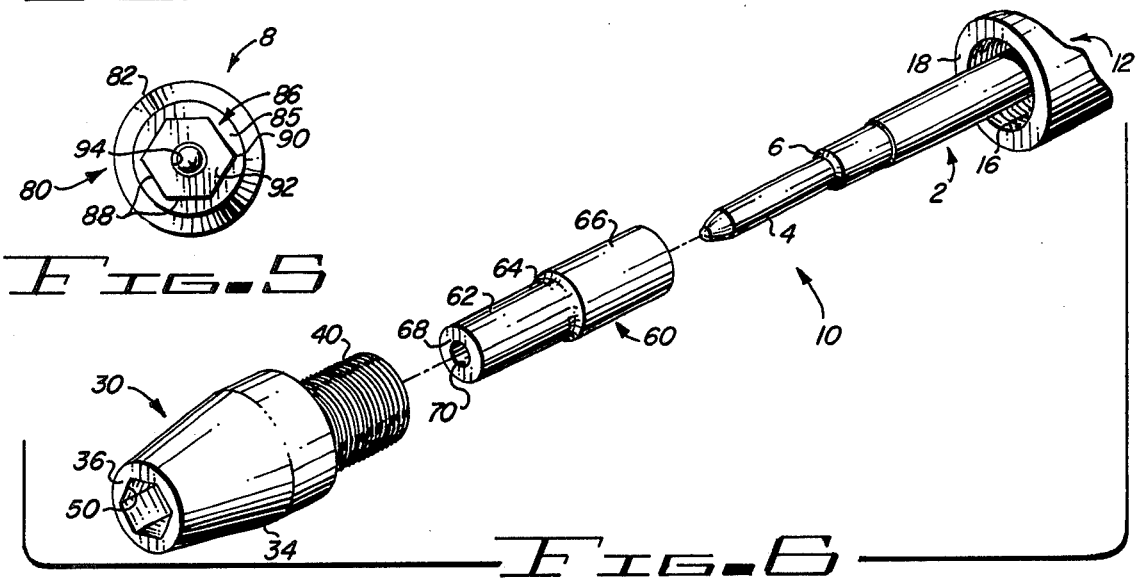
FIG. 6

PEN LOCK APPARATUS

BACKGROUND OF THE INVENTION

1. Field of the Invention

This invention relates to a writing pen using a replaceable ball point pen cartridge which is locked into the pen, and, more particularly, to a pen which includes a removable point which locks the ball point pen cartridge within the pen and which requires a wrench or key to remove the tip to replace the cartridge.

2. Description of the Prior Art

A chronic problem in business establishments which are frequented by people who must fill out documents, such as banks, post offices, and various types of government organizations, city, state, and federal, is the loss of pens. The business establishments provide pens as writing implements for the convenience of their customers or clientele and, as a result of the continual losses, must replace the pens regularly.

This loss has been alleviated by using a pen holder which may be secured to a counter or desk and by a pen connected to the holder by a stranded cable. The cable type connection replaces pens which use a cord or a bead type chain, both of which may be easily broken or cut. However, unless there is some way to prevent the pen from being taken apart, the ball point cartridge may easily be removed from the pen even though the pen itself may not be taken. It is accordingly necessary to provide a lockable pen.

The next step in preserving the pen for the business establishments was to develop a lock system to prevent the pen from being taken apart without the use of a special tool or key to unlock cooperating parts of the pen. U.S. Pat. No. 3,570,284 discloses such a lock system. The lock system employed in the U.S. Pat. No. 3,570,284 comprises a pen which includes a removable tip and a movable insert in the tip. The barrel or cylinder of the pen includes a circumferentially extending groove, with a matching groove on the tip. A small ball is disposed in the matching grooves to lock the pen barrel and the tip together. The movable insert within the tip includes a detent or groove into which, when the detent or groove is aligned with the grooves in the barrel and in the tip, allows the ball to be moved out of the grooves in the cylinder or barrel and the tip and into the movable insert. This allows the tip to be unscrewed and removed from the barrel for replacing the cartridge.

The movable insert comprises a lock member which is moved into alignment with the ball and the grooves by the employment of a tool which fits over the point of the pen cartridge and is inserted into the tip to move the insert or lock member in order to release the ball.

While the apparatus disclosed in the U.S. Pat. No. 3,570,284 has enjoyed substantial success, there are, nevertheless, limitations. For example, if one were to lose the ball during the process of taking the pen apart to replace a cartridge, the locking feature will be lost. Moreover, the use of the matching grooves among the cooperating parts requires extra machining, which, if eliminated, would substantially reduce the manufacturing costs of the pen apparatus.

The apparatus of the present invention provides means for locking the tip and a cylindrical barrel of a pen together without the use of detents, grooves, or the like, and accordingly is simpler and less expensive to manufacture than the pens of the prior art.

SUMMARY OF THE INVENTION

The apparatus described and claimed herein utilizes a hexagonal bore within a tip threadedly secured to a pen barrel or cylinder, and an insert through which the point of a pen cartridge extends for writing purposes. A wrench or key is used to unlock the tip from the barrel by means of an external hexagonally shaped portion which moves the insert out of the hexagonal bore and the wrench or key is then used to disengage the threads to remove the tip from the barrel.

Among the objects of the present invention are the following:

To provide new and useful pen apparatus;

To provide new and useful pen apparatus in which the pen includes a removable tip;

To provide new and useful pen apparatus which includes a wrench to unlock a threaded engagement between a tip and a barrel of a pen;

To provide new and useful pen apparatus including a geometric configuration for locking and unlocking mating portions of the apparatus;

To provide new and useful pen apparatus having a simplified construction;

To provide new and useful locking pen apparatus requiring a wrench or key to unlock the apparatus; and To provide new and useful pen apparatus including threadedly engaging portions including a geometrically configured interior bore having a matingly engaging geometrically configured wrench to engage and disengage the threaded portions of the apparatus.

BRIEF DESCRIPTION OF THE DRAWING

FIG. 1 is a perspective view of pen apparatus of the present invention.

FIG. 2 is a view in partial section of the apparatus of FIG. 1 taken generally along line 2—2 of FIG. 1.

FIG. 3 is an enlarged view of the apparatus of the present invention illustating the initial engagement of the pen and the wrench illustrated in FIGS. 1 and 2.

FIG. 4 is a view in partial section indicating the sequential engagement of the pen and wrench apparatus illustrated in FIG. 3.

FIG. 5 is a front view of the pen apparatus of the present invention taken generally along line 5—5 of FIG. 2.

FIG. 6 is an exploded perspective view of the pen apparatus of the present invention.

DESCRIPTION OF THE PREFERRED EMBODIMENT

FIG. 1 comprises a perspective view of the pen apparatus of the present invention, including a pen 10 and a wrench 80 which is used to secure together and to separate portions of the pen 10 to remove and replace a cartridge, generally designated by reference numeral 2, disposed within the pen. The cartridge 2 includes a point 4 which extends outwardly from the pen. The cartridge is of the well-known ballpoint type which includes an integral supply of ink housed within the cartridge and communicating directly with the point.

The pen 10 includes a cylindrical body or barrel 12 having an interior bore 14 in which most of the pen cartridge 2 is located. The pen 10 also includes a front portion or tip 30. The tip 30 includes a barrel or cylindrical portion 32, which is substantially the same diameter as the adjacent barrel or cylinder 12. The tip also includes an inwardly and forwardly tapering conical portion 34. The conical portion 34 is in the configuration of a truncated cone extending inwardly and forwardly from the cylindrical portion 32, and which terminates at a forward shoulder 36. The shoulder 36 is substantially perpendicular to the longitudinal axis of the pen 10.

The tip 30 also includes an interior, longitudinally axially extending bore which is a continuation of the bore 14 of the cylinder 12 and which receives the forward portion of the pen cartridge 2. The tip 30 further includes an insert 60, the front portion of which is generally flat or planar and is substantially coextensive with the front shoulder 36 of the tip 30. The tip 4 of the pen cartridge 2 extends axially through and outwardly from the cylinder 12, the tip 30, and the insert 60, as shown in FIG. 1.

In order to separate the tip 30 from the cylinder 12, a key or wrench 80 is used. The wrench 80 includes a cylindrical portion 82 which is larger in diameter than the cylinder or barrel 12 of the pen 10. The cylindrical portion 82 is knurled or milled on its outer periphery to facilitate the grasping and turning of the wrench with respect to the pen, as will be discussed in detail below. The forward or front portion of the wrench 80 includes a hexagonally shaped insert or key portion 86, which extends on its longitudinal axis outwardly from the cylindrical portion 82. Between the cylindrical portion 82 and the insert 86 is a transition portion 84 which simply curved downwardly and forwardly toward the insert 86, and terminates in a shoulder 85 at the insert 86. The shoulder 85 extends radially outwardly from the hexagonal insert 86 and tapers rearwardly to blend smoothly with the transition area 84. The insert 86 comprises a longitudinally or axially extending key portion with a hexagonal outer configuration which is adapted to be received within the hexagonally configured portion of the tip 30 of the pen, as will be discussed in detail below.

The insert 86 includes six generally planar rectangular sides 88 which join together at six longitudinally extending edges 90. The sides and edges comprise the hexagonal external configuration of the key or insert 86.

The hexagonal key or insert 86 includes a longitudinally extending bore 90 centrally located with respect to the insert. The diameter of the bore 90 is slightly larger than the tip 4 of the pen cartridge 2. The axial length of the bore 90 is slightly longer than the axial length of the tip 4 of the pen cartridge which extends outwardly from the tip 30 of the pen 10. That is, the bore 90 is slightly larger than the exposed portion of the tip 4 which extends forwardly from the forward shoulder 36 and from the insert 60. When the wrench 80 is used with the pen 10, the tip 4 is received into the bore 90, as illustrated below in conjunction with FIGS. 3 and 4.

The hexagonal insert 86 also includes a smoothly rounded front face 92 extending radially outwardly from the bore 90 to the hexagonal sides of the insert. The purpose for having the face slightly rounded, and smooth, particularly at the juncture of the face and the hexagonal portion of the insert is to allow the insert to be smoothly and rapidly inserted into the tip 30 of the pen 10, as discussed below.

FIG. 2 is a side view in partial section of the pen apparatus of FIG. 1 taken generally along line 2—2 of FIG. 1. Both the wrench 80 and the pen 10 are illustrated, with the key or insert 86 of the wrench 80 facing or disposed adjacent the point 4 of the cartridge 2. The cartridge 2 is shown disposed on the longitudinal axis of the pen 10 within the bore 14 of the cylindrical housing or barrel 12. The point 4 of the cartridge 2 is shown extending outwardly from the tip 30 of the pen, and spaced apart from the hexagonal insert 86 of the wrench 80.

The pen cylinder 12 includes an internally threaded portion 16 located forwardly of the interior bore 14. The threaded portion 16 is a continuation, and the forward portion, of the bore 14. The cylinder 12 terminates at an exterior shoulder 18, which is disposed against a mating shoulder or abutting face 42 of the pen tip 30. The tip 30 also includes, rearwardly of the abutting face or shoulder 42, an externally threaded portion 40 which matingly engages the internal threads 16 of the cylinder 12. Preferably, the mating threads 16 and 40 are left-handed threads.

The tip 30 of the pen includes an interior bore 56 which comprises a continuation of the bore 14 of the pen barrel 12, but with a slightly reduced diameter. At the forward or front portion of the tip 30, primarily within the conical portion 34, is a hexagonally shaped bore 50. The hexagonally shaped bore 50 comprises a forward bore of the tip, while the bore 56 comprises a rear bore. Between the forward bore 50 and the rear bore 56 is a sloping wall 54 that extends outwardly and rearwardly from the rear end of the forward bore 50 to the bore 56. The sloping wall 54 comprises a transition portion between the two bores. The hexagonally shaped bore 50 receives the hexagonal key or insert 86 of the wrench 80, as shown in FIG. 4 and as discussed below.

The insert 60 is generally cylindrical in configuration. The insert 60 has a pair of internal bores, including a forward bore 70 and a rear bore 74. The forward bore 70 is slightly larger in internal diameter than the external diameter of the point 4 of the cartridge 2, which extends through the bore. Between the bore 70 and the bore 74 is a shoulder 72. The diameter of the bore 74 is slightly larger than the diameter of the bore 70. Thus the shoulder 72 extends radially outwardly from the bore to the bore 74 and the shoulder faces the bore 74. Externally, the tip includes a front cylindrical portion 62 and a rear cylindrical portion 66 and a sloping shoulder 64 between the portions 64 and 66. The shoulder 64 engages the sloping wall or shoulder 54 of the tip 30.

The pen cartridge 2 is primarily an elongated cylinder 8, which houses the ink for the pen, and the cylinder 8 is generally made of plastic, while the tip is made of metal. The tip is of a lesser diameter than is the cylinder 8, and an inwardly sloping shoulder 6 is defined between the point 4 and the cylinder 8. The shoulder 6 abuts or is disposed against the rearwardly facing shoulder 72 of the insert 60. As is typical and well known in pen installations, the cartridge 2 is spring biased to hold it against the insert and within the pen 10. In other words, there is a compression spring, not shown, which biases the pen cylinder 8, and the point 4, to the position shown in FIGS. 1 and 2. The spring, well known in the art, provides a constant biasing force to hold the shoulder 6 of the cartridge 2 against the shoulder 72 of the insert 60. The same biasing force urges the insert 60 against the tip 30. The slope of the sloping wall 54 of the tip 30 and the slope of the shoulder 64 of the insert 60 is substantially identical, and accordingly under the bias of the spring against the cylinder 8 of the cartridge 2, the sloping wall 6 of the cartridge is urged against the shoulder 72 of the insert, and the biasing force is transmitted through the insert 60 to urge the shoulder 64 of the insert against the sloping wall or shoulder 54 of the tip 30.

The spring bias discussed in the preceding paragraph is sufficiently strong, as it exerts a force on the cartridge 2, to enable the point 4 of the cartridge to remain in the position substantially as shown in FIGS. 1 and 2 while a user is writing with the pen. However, the spring is yieldable and if a force of a sufficient magnitude is extracted against the point, the point will retract into the tip to prevent injury to the point. The spring bias accordingly serves a dual function, the first function of holding the cartridge in place for writing with the pen, and the second function of preventing the cartridge from being injured due to dropping the pen, or the like, on the point.

To remove the tip 30 from the cylinder or barrel 12, the wrench 80 is moved toward the tip until the point 4 has been received in the bore 90 (see FIG. 1) and the insert 86 is moved axially inwardly to enter the hexagonally shaped bore 50, as illustrated below. In FIG. 2, the cylindrical portion 82 of the wrench 80 is shown as being about the same as the diameter of the cylinder 12 of the pen, but this is merely for illustrative purposes therein. The diameter of the cylindrical portion 82 is somewhat larger than the diameter of the barrel 12 to provide maximum mechanical advantage in using the wrench to unscrew the tip 30 from the cylinder or barrel 12. The knurled or milled edges of the wrench 80 are also a factor, in addition to the diameter of the cylindrical portion, in enabling the wrench to be easily used to remove the tip 30 from the barrel 12. The use of the milled edges allows the frictional engagement between the user's fingers (and thumb) and the wrench that provides a substantially improved grip over a smooth surface, such as the surface of the pen barrel 12.

It will be noted from FIG. 2 that the external diameters of the pen barrel or cylinder 12 and the cylindrical portion 32 of the tip 30 are substantially the same at the mating shoulders 18 and 42 of the barrel and tip, respectively. If desired, the pen barrel 12 may taper inwardly rearwardly of the tip. However, it is preferable that, at and adjacent the juncture of the tip and the barrel, the outer surfaces be substantially coextensive.

The outer surface of both the pen barrel 12 and the tip 30, including the cylindrical portion 32 of the tip and the conical portion 34, are smooth, and grasping the tip 30 with sufficient force to provide a twisting force that results in relative motion between the tip and the barrel is rather difficult. The barrel 12 may be grasped with one hand, using as many fingers (and thumb) as required to hold the barrel, but the relatively short axial length of the cylindrical portion 32 of the tip 30 does not provide sufficient length, axially, to allow the tip to be grasped or held to move the tip and the barrel relative to each other to unscrew the tip from the barrel. Moreover, the conical portion 34 of the tip 30 presents an even more difficult surface to grasp than the cylindrical portion 32 of the tip, due to the decreasing diameter and the smooth outer surface. Accordingly, it is rather difficult to detach the tip from the barrel without the use of a mechanical device, such as the wrench 80. It will be noted that the left-handed threads preferably used on the tip and the barrel also aid in preventing undesired separation of the tip from the barrel. Normally, when a person realizes that there is a threaded engagement between two members or elements, the immediate thought is that typical, right-handed threads are used. Accordingly, the use of left-handed threads is a psychological, if not actual, barrier towards separating the tip from the barrel of the pen.

From the side view in FIG. 2, it is noted that the exterior diameter of the insert 60 is substantially the same as the interior diameter of the bore 50 of the tip 30. However, it will also be noted that the bore 50 is of a hexagonal configuration, and since the insert 60 is preferably of a circular, cylindrical configuration, the insert will not matingly engage the entire inner surface of the bore 50, but rather the exterior periphery of the insert 60 within the bore 50 will be generally tangent to each of the six planar sides of the bore 50.

With the sloping walls 54 and 64 of the tip 30 and the insert 60, respectively, in contiguous engagement, as illustrated in FIG. 2, the insert 60 extends forwardly substantially even with the forward shoulder 36 of the tip 30. The insert 60 includes a generally flat face 68 which is in the same plane as the shoulder 36 when the insert is disposed against the tip, as shown in FIG. 2. This provides a generally coextensive face or shoulder to the pen apparatus adjacent the point 4 where the point extends outwardly from the pen 10.

The smooth front face 92 of the wrench 80 is clearly shown in the side view of FIG. 2, with the face including a smoothly curving portion adjacent the edges 90 where the sides 88 join together. It will be noted that at the junctures or edges 90, the face 92 extends rearwardly a slight bit more than where the face 92 joins the planar sides 88. In other words, the juncture of the face 92 with the edges 90 includes a smoothly curving portion extending rearwardly of the juncture of the face 92 and the planar portion of the sides 88. The reasons for this will be discussed below in conjunction with FIGS. 3 and 4.

FIG. 3 is a side view in partial section showing the wrench 80 contacting the pen 10, with the point 4 of the pen cartridge 2 received in the bore 94 of the wrench 80. The front face 92 of the wrench 80 is disposed against the face 68 of the insert 60 of the pen. The hexagonal insert 86 is oriented appropriately to be received in the hexagonal shaped bore 50 of the tip 30.

The depth of the bore 94 within the insert 86 is sufficient to completely receive the exposed portion of the tip 4 of the cartridge 2 since the cartridge 2 is biased against the insert 60, with the sloping shoulder 6 at the juncture of the cylinder 8 and the point 4 disposed against the internal shoulder 72 of the insert 60. The point 4 is accordingly limited as to the extent of its extension outwardly from the point 30. The bore 94 is of sufficient length (or depth) to allow the point 4 to extend into the bore 94 of the insert 86 without bottoming out when the wrench 80 is inserted against and into the tip 30 of the pen apparatus 10.

FIG. 4 is a view in partial section showing sequentially the insertion of the hexagonal key or insert 86 into the matching or mating hexagonal internal bore 50 of the tip 30. The insert 60 is moved partially out of the bore 50 against the bias of a spring (not shown) disposed between the cylinder 12 and the cartridge 2, as discussed above. The shoulder 85 of the wrench 82 is disposed against the shoulder 36 of the tip 40. The wrench 80 is accordingly fully engaged with the tip 30 of the pen. To aid in orienting the wrench 80 with respect to the pen 10, and to prevent scratching, burrs, etc. The face 92 is flat and smooth, as are the faces 36 and 68 of the tip 30 and insert 60, respectively. Moreover, the transition areas from the face 92 to the planar sides 88 and the junctures 90 are smoothly rounded, as discussed above.

To disengage the tip 30 from the pen barrel 12 (see FIGS. 1 and 2) the user grasps with one hand (thumb and one or two fingers) the wrench 80 at its cylindrical portion 82, where the knurled or milled edges enhance the ability of the user to hold and rotate the wrench 80 relative to the pen barrel or cylinder 12. The pen barrel 12 may be held with the other hand, as convenient with the user. With left-handed threads securing the tip to the pen barrel, the wrench 80 will be turned to the right, or clockwise relative to the pen barrel 10, as viewing the pen barrel in either FIGS. 1 or 6 to remove or separate the tip from the barrel. To threadedly engage the tip and the pen barrel, the opposite turning is required of the wrench 80 relative to the pen barrel 12.

FIG. 5 is a front view of the wrench 80 taken generally along line 5—5 of FIG. 2. The bore 94 is shown centered on the hexagonal insert 86, and extending back or rearwardly (inwardly) from the front face 92. The hexagonal shape of the insert 86 is clearly illustrated as being comprised of six planar sides 88, each side of which is joined to the adjacent side to define a plurality of junctures or edges 90. The shoulder 85 extends radially outwardly from the insert 86 to the transition area or portion 84. In turn, the transition area 84 extends upwardly and rearwardly to the cylindrical portion 82 of the wrench.

FIG. 6 is an exploded perspective view of the pen apparatus 10. The pen 10 is separated into its three primary components or elements, namely, from left, the tip 30, the insert 60, and the cylinder or barrel 12. The replaceable cartridge 2 is shown extending outwardly from the barrel 12.

The cylinder portion 32 of the tip 30 is substantially the same diameter as the diameter of the cylinder or barrel 12, thus providing a smooth, continuous outer surface when the external threads 40 of the tip 30 engage the internal threads 16 of the barrel 12. Tapering forwardly and inwardly from the cylindrical portion 32 of the tip 30 is the conical portion 34, which is in the configuration of a truncated cone, terminated at its minimum diameter portion by a forward shoulder 36. The forward shoulder 36, which comprises a front face for the tip 30, is substantially perpendicular to the longitudinal axis of the pen apparatus 10.

FIG. 6 clearly shows the hexagonal configuration of the interior bore 50 of the tip 30, which extends axially inwardly from the front face or shoulder 36. The bore 50 receives the hexagonal key or insert 86 of the wrench 80 (see FIG. 4).

The insert 60 is shown disposed between the point 4 of the cartridge 2, which extends outwardly from the cylinder 12, and the tip 30. The insert 60 includes two cylindrical portions, a forward cylindrical portion 62 and a rear cylindrical portion 66. The diameter of the front cylindrical portion 62 is less than the diameter of the rear cylindrical portion 66. A sloping shoulder 64 extends between the two cylindrical portions of the insert 60.

The bore 70 is shown in FIG. 6 as extending along the longitudinal axis rearwardly of the insert 60 from the front face 68 of the insert. The interior diameter of the bore 70 is slightly greater than the exterior diameter of the point 4 of the cartridge 2, which extends through the bore 70 and outwardly or forwardly from the pen apparatus 10 (see FIGS. 1 and 2). The exterior diameter of the forward cylindrical portion 62 of the insert 60 is substantially the same as the major diameter of the hexagonal bore 50 of the tip 30, and thus, when the insert 60 is disposed within the tip 30, there is minimum clearance or play between the insert and the tip.

The insert 60 includes an interior shoulder 72 (see FIGS. 2 and 3) against which the shoulder 6 of the cartridge bears when the pen apparatus 10 is secured together. As indicated above, the cartridge 2 is spring biased by a compression spring (not shown) extending between the cartridge into engagement with the insert 60, and to further urge the insert 60 into engagement with the tip 30, as illustrated above in FIGS. 2 and 3.

The tip 30 may be assembled to the cylinder 12 manually, without using the wrench or key. However, only a "finger tight" engagement may be made, which provides only minimum contact between the exterior shoulder 18 of the cylinder or barrel 12 with the rear shoulder or abutting face 42 (see FIG. 2) of the tip 30. The limiting factor of the manual engagement between the tip and the pen barrel is due to the lack of surface area on the tip that a user may grasp. The cylindrical portion 32 of the tip does not provide adequate area to grasp due to its limited axial length and the smoothness of the exterior surface. Moreover, the conical portion 34 presents an even more difficult area to manually grasp due to its configuration and its relatively small surface area and also due to its smooth surface. While the exterior surface of the cylinder or barrel 12 is also smooth, since it is of substantially greater axial length than the tip 30, and accordingly of substantially greater area than the tip, a user is able to hold the cylinder barrel relatively securely while putting on or taking off the tip from the barrel. It is accordingly necessary to use the wrench 80 to securely fasten the tip to the barrel and to remove the tip from the barrel, or to at least begin the removal of the tip from the barrel.

What is claimed is:

1. Pen lock apparatus, comprising in combination:

a barrel for receiving a spring biased pen cartridge, including a first bore in the barrel in which the cartridge is disposed, a first shoulder at one end of the barrel, and an internally threaded portion in the first bore adjacent the shoulder;

a tip secured to the barrel, including first bore means, a second shoulder in the first bore means, an externally threaded portion for matingly engaging the internally threaded portion of the first bore of the barrel, and a third shoulder adjacent the externally threaded portion and disposed against the first shoulder of the barrel when the tip is secured to the barrel;

insert means movably disposed in the first bore means of the tip, including a fourth shoulder disposed against the second shoulder of the first bore means of the tip, second bore means for receiving the spring biased cartridge, including a fifth shoulder in the second bore means against which a portion of the spring biased cartridge is disposed; and a wrench for locking and unlocking the tip from the barrel, including a cylindrical portion for grasping by a user, key means secured to the cylindrical portion and insertable into the first bore means of the tip to engage and disengage the threaded portions of barrel and tip, and third bore means for receiving a portion of the pen cartridge.

2. The apparatus of claim 1 in which the first bore means of the tip includes a first bore portion and a second bore portion, and the second shoulder is disposed between the first bore portion and the second bore portion.

3. The apparatus of claim 2 in which the insert means includes a first portion disposed in the first bore portion of the first bore means of the tip, a second portion disposed in the second bore portion of the first bore means, and the forth shoulder is disposed between the first and second portions of the insert means.

4. The apparatus of claim 3 in which the first bore portion of the first bore means is hexagonally configured.

5. The apparatus of claim 4 in which the key means of the wrench means is hexagonally configured to matingly engage the hexagonally configured first bore portion of the first bore means.

* * * * *